United States Patent [19]

Hruda et al.

[11] 4,121,268

[45] Oct. 17, 1978

[54] ELECTROLYTIC CELL VACUUM SWITCHING SYSTEM

[75] Inventors: Robert M. Hruda, Horseheads; Paul O. Wayland, Montour Falls, both of N.Y.

[73] Assignee: Westinghouse Electric Corp., Pittsburgh, Pa.

[21] Appl. No.: 776,326

[22] Filed: Mar. 10, 1977

[51] Int. Cl.[2] ..... H01H 33/66

[52] U.S. Cl. ..... 361/3; 307/134; 361/13

[58] Field of Search ..... 361/3, 8, 2, 13; 200/145; 307/134, 135, 137, 141.8, 146

[56] References Cited

U.S. PATENT DOCUMENTS

| | | | |
|---|---|---|---|
| 1,865,274 | 6/1932 | Prince | 361/3 X |
| 3,489,918 | 1/1970 | Greenwood | 307/135 |

FOREIGN PATENT DOCUMENTS

| | | | |
|---|---|---|---|
| 2,242,696 | 4/1973 | Fed. Rep. of Germany | 307/135 |

OTHER PUBLICATIONS

"A High Speed HVDC Circuit Breaker With Crossed--Field Interrupters" IEEE Transactions on Power Apparatus and Systems, vol. PAS-95, No. 4, pp. 1182-1193, 7/76.

*Primary Examiner*—Harry E. Moose, Jr.
*Attorney, Agent, or Firm*—W. G. Sutcliff

[57] ABSTRACT

A vacuum switch system for interrupting electrolytic cell circuits designed to operate at very high current, relatively low DC voltage. The DC voltage is above the minimum cathode drop potential for the vacuum switch contact material. The system includes plural parallel circuit paths, with one of the parallel circuit paths including at least two serially connected vacuum switches. The operating means for opening and closing all the switch contacts includes means responsive to the opening of the vacuum switches to simultaneously open the serially connected vacuum switches in the parallel path.

6 Claims, 3 Drawing Figures

ELECTROLYTIC CELL VACUUM SWITCHING SYSTEM

BACKGROUND OF THE INVENTION

The present invention relates to current interrupting switching systems. More particularly, it deals with vacuum switches used in systems for interrupting the very large low voltage DC currents associated with electrolytic chemical cells, such as chlor-alkali cells. In such cells, several thousand amperes of current are continuously passed through a solution to effect separation of desired chemical constituents. Numerous cells are operated electrically in series at a low DC voltage which had been typically ten volts or less, but more recent cells operate at about fifty volts.

Periodic maintenance requirements dictate the need for low voltage, high current interrupting switching means for isolating a single cell from the remainder of the electrically series cells. A recent development has been to utilize vacuum switches, such as seen in U.S. Pat. No. 3,950,628, as the switching or current interrupting means with such cells. Other vacuum switches and the operating mechanism for such switches designed for use with electrochemical cells are set forth in copending applications Ser. No. 650,322 filed Jan. 19, 1976, and Ser. No. 650,406 filed Jan. 19, 1976, both of which applications are owned by the assignee of the present invention. A vacuum switch has at least one movable contact disposed within a hermetically sealed evacuated chamber. The switch or several parallel switches are shunt connected across the cell, and when maintenance is required on the cell, the contacts are closed to divert the current around the cell. The contacts of the switch are moved apart to the open switch position to place the cell back into the service.

Since the cells are typically operated at about ten volts or less, it is possible to separate the contacts and quickly extinguish the arc which forms between the contacts as they are separated. The contacts are typically copper or copper alloy, which exhibits a characteristic DC cathode drop potential in a vacuum, below which potential an arc cannot be maintained between separated contacts. For copper, this cathode drop potential is about twenty volts. The vacuum switch takes advantage of this cathode drop potential in extinguishing the arc.

With newer electrolytic cells the DC operating potential is about fifty volts. Since this voltage is above the cathode drop potential for most contact materials it is not possible to extinguish the arc with the vacuum switch, and thus vacuum switches have not been used with such higher DC voltage cells.

In the AC power transmission technology it is a common practice to use parallel vacuum interrupters, with series connected vacuum interrupters in one parallel path to boost the voltage withstand capability of the interrupter system. The series connected interrupters can withstand the rapid buildup of a high AC transient recovery voltage which is impressed across such interrupters shortly after the current zero interruption. In such AC systems, the voltage across the devices swings through zero facilitating interruption before the recovery voltage buildup.

In a DC vacuum switch system, there is no change in the voltage impressed across the system and extinguishment of the arc is achieved by separating the contacts and having the cathode drop potential for the vacuum switch exceed the DC line voltage for the system. No arc can be maintained under such a condition and there is arc extinguishment and interruption of the very high line current.

SUMMARY OF THE INVENTION

A vacuum switch system is detailed which permits interruption or switching of higher DC operating potential electrolytic cells. The system includes plural parallel circuit paths with a vacuum switch in each parallel circuit path, with one of the paths including at least two serially connected vacuum switches. The serially connected vacuum switches, when both are open, have a summed cathode drop potential which exceeds the DC operating potential of the system. The operating means for opening and closing the vacuum switches of the system are such that the serially connected switches in the one parallel circuit path are simultaneously opened at a predetermined time after the switches in the other parallel circuit paths.

DESCRIPTION OF THE PREFERRED EMBODIMENT

Figure 1:
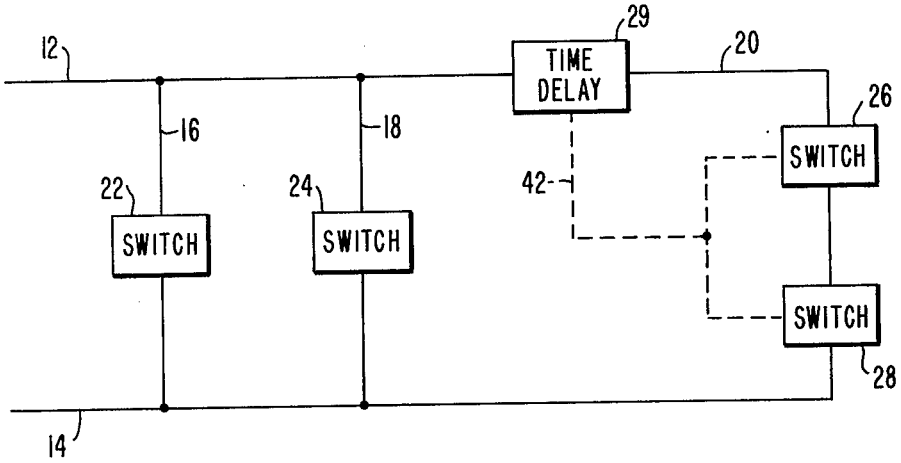
FIG. 1 is a schematic illustration of the vacuum switch system of the present invention.

The invention can be best understood by reference to the exemplary embodiment seen in schematic form in FIG. 1.

The vacuum switch system 10 seen in FIG. 1 includes load connection buses or lines 12 and 14, which are connected to the anode and cathode of an electrolytic cell not shown. A plurality of electrically parallel circuit paths 16, 18, 20 branch between the lines 12 and 14. The circuit paths 16 and 18 each have a single vacuum switch 22, 24 in the respective paths. In circuit path 20, two serially connected vacuum switches 26 and 28 are disposed. A time delay means 29 is shown disposed between the parallel paths 16 and 18 and the path 20 for delaying the operation of opening means 42 for simultaneously opening the switches 26 and 28 a short time after the switches 22 and 24 are opened.

A DC operating potential of about 50 volts is present across the lines 12 and 14, and when all the vacuum switches are closed very high DC currents of several thousand amperes pass through the parallel paths 16, 18 and 20. When it is desired to interrupt the current through the system 10, the vacuum switches 22 and 24 are opened by separating the contacts of each switch approximately simultaneously, while switches 26 and 28 are still closed. All of the current flowing in the system now is shunted through path 20 and this permits extinguishment of the arcs formed in switches 22 and 24 when they are opened. After a predetermined delay sufficient to guarantee arc extinction in switches 22 and 24, but not so long as to permit overheating of the serially connected switches 26, 28, with a typical delay time of at least 50 milliseconds, the time delay means 29 which is actuated when switches 22 and 24 open, causes operating mechanism 42 to simultaneously open switches 26 and 28. The cathode drop across the two serially connected switches 26 and 28 exceeds twice the drop across a single switch by itself. In this way the serially connected switches can effectuate interruption of the current. It is of course possible to provide more than two serially connected switches in the parallel line 20 to further increase the cathode drop.

Figure 2:
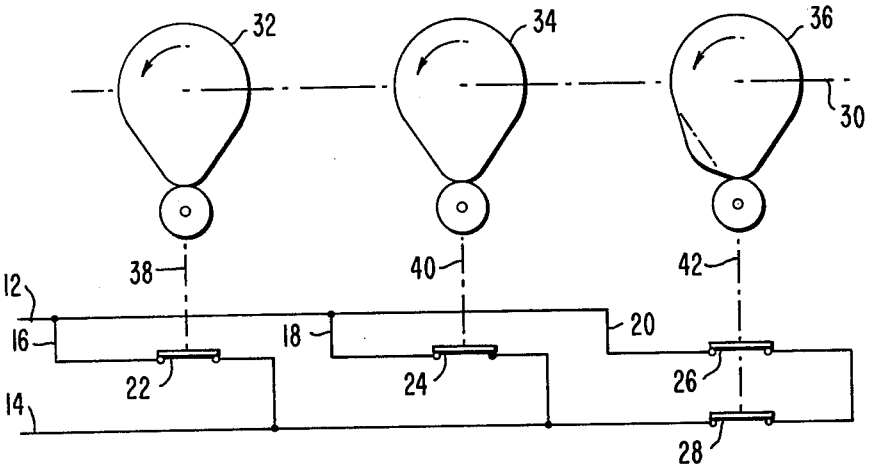
FIG. 2 is a schematic representation of the operating mechanism portion of the system.

The vacuum switches and their relationship to an exemplary operating mechanism per the above operating description are seen in greater detail in FIG. 2. This basic parallel path switch and operating mechanism is described in detail in the aforementioned copending application Ser. No. 650,406, which is incorporated by reference herein, but there is no provision for serially connected switches in one parallel path. The earlier system was limited in use to low voltages of less than about 20 volts. In this earlier system the operating mechanism included a common rotatable shaft with cams mounted on the shaft connected to the vacuum switch in each parallel path via an elongated linearly movable arm which acted on one side of the vacuum switch to effect opening and closing of the switch.

Figure 3:
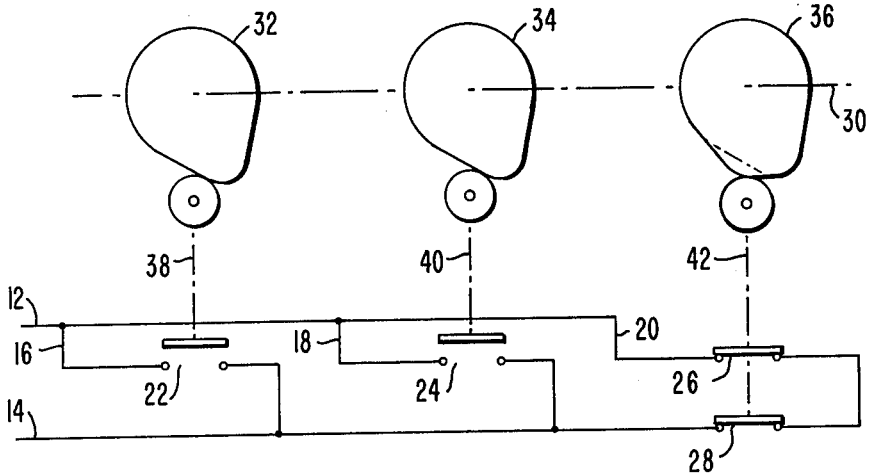
FIG. 3 is a schematic representation of the operating mechanism portion of the system which illustrates a time delay means for opening of switches 26 and 28.

The same basic operating mechanism described in the aforementioned copending application is usable in practicing the present invention with the additional parallel path 20 which includes the serially connected vacuum switches. This operating mechanism is schematically illustrated in FIGS. 2 and 3. A common rotatable shaft 30 has eccentrics 32, 34, and 36 mounted thereon. The eccentrics operate connecting links 38, 40 and 42 respectively which effect opening and closing of the contacts of switches 22, 24, 26, and 28. The link 42 is connected to simultaneously operate switches 26 and 28. The eccentrics 32 and 34 are identical, while eccentric 36 has an enlarged area of eccentricity 44 which permits switches 26 and 28 to remain closed for the short time after opening of switches 22 and 24 as illustrated in FIG. 3. Further shaft rotation and eccentric rotation will open switches 26 and 28 as well. FIG. 2 illustrates the relationship of the eccentrics when the switches are all closed.

While the enlarged area of eccentricity of eccentric 36 serves as a mechanical time delay means 29, other time means could be utilized including an electronic means which could sense change in current in the parallel path 20. The electronic means could then actuate operating mechanisms such as air or hydraulic cylinders after the requisite time delay.

What is claimed is:

1. A vacuum switch system for interrupting high DC current, low DC voltage circuits at a DC operating line voltage for the circuit which exceeds the cathode drop potential for the particular cathode contact material used comprising:

(a) at least two parallel circuit paths, a first such path including at least one vacuum switch, and a second such path including at least two serially connected vacuum switches;

(b) means responsive to the opening of the vacuum switch in the first path for simultaneously opening the two serially connected vacuum switches a predetermined time after the vacuum switch in the first path is opened.

2. The vacuum switch system set forth in claim 1, wherein a plurality of simultaneously operable vacuum switches are disposed in parallel in the first path.

3. A vacuum switch system for interrupting low DC voltage, high current circuits, which low DC voltage exceeds the cathode drop potential for the vacuum switch contact material used comprising:

(a) plural parallel electrical circuit paths, with a first path including a single vacuum switch, with at least one other such path including at least two serially connected vacuum switches;

(b) operating means for opening and closing the vacuum switches including means responsive to the opening of the vacuum switch in the first path for simultaneously opening the two serially connected vacuum switches a predetermined time after the vacuum switch in the first path is opened.

4. An electrolytic cell vacuum switching system for cells in which the DC voltage exceeds the cathode drop potential for the vacuum switch contact material used comprising:

(a) plural parallel electric circuit paths, with a first path including a single vacuum switch, with at least one other such path including at least two serially connected vacuum switches;

(b) operating means for opening and closing the vacuum switches including means responsive to the opening of the vacuum switch in the first path for simultaneously opening the two serially connected vacuum switches a predetermined time after the vacuum switch in the first path is opened.

5. The switching system set forth in claim 4, wherein the operating means includes a common rotatable shaft with a plurality of eccentrics mounted on the shaft, with an eccentric for each parallel electric circuit path, and wherein the eccentrics are connected to operating links for opening and closing the vacuum switch contacts.

6. The switching system set forth in claim 5, wherein the eccentric associated with the series connected vacuum switches has an enlarged area of eccentricity compared to the eccentric associated with the other parallel electric circuit path, to provide a time delayed opening of the series connected vacuum switches after the other vacuum switch is opened.

* * * * *